US009622300B2

(12) United States Patent
Knoedgen

(10) Patent No.: US 9,622,300 B2
(45) Date of Patent: Apr. 11, 2017

(54) RESONANCE CONVERTER FOR DRIVING MULTIPLE AC LED STRINGS

(71) Applicant: Dialog Semiconductor (UK) Limited, Reading (GB)

(72) Inventor: Horst Knoedgen, Munich (DE)

(73) Assignee: Dialog Semiconductor (UK) Limited, Reading (GB)

( * ) Notice: Subject to any disclaimer, the term of this patent is extended or adjusted under 35 U.S.C. 154(b) by 0 days.

(21) Appl. No.: 14/693,923

(22) Filed: Apr. 23, 2015

(65) Prior Publication Data

US 2016/0157306 A1 Jun. 2, 2016

(30) Foreign Application Priority Data

Dec. 1, 2014 (DE) ..... 10 2014 224 564

(51) Int. Cl.
*H05B 33/08* (2006.01)

(52) U.S. Cl.
CPC ..... *H05B 33/0815* (2013.01); *H05B 33/0803* (2013.01); *H05B 33/0818* (2013.01)

(58) Field of Classification Search
CPC ..... H05B 33/0803; H05B 33/0818
See application file for complete search history.

(56) References Cited

U.S. PATENT DOCUMENTS 7,408,308 B2 8/2008 Sawada et al.
2013/0271021 A1* 10/2013 Elferich ..... H02M 1/4258 315/206

FOREIGN PATENT DOCUMENTS

| | | |
|---|---|---|
| DE | 10 2010 041 632 | 3/2012 |
| DE | 102012224212 | 6/2014 |
| DE | 10 2014 244 564.8 | 5/2015 |
| EP | 1 685 745 | 5/2013 |
| WO | WO 2009/147563 | 12/2009 |
| WO | WO 2010/097407 | 9/2010 |

* cited by examiner

*Primary Examiner* — Douglas W Owens
*Assistant Examiner* — Pedro C Fernandez
(74) *Attorney, Agent, or Firm* — Saile Ackerman LLC; Stephen B. Ackerman

(57) ABSTRACT

An SSL assembly is described, which comprises an alternating current, referred to as AC, solid state lighting, referred to as SSL, unit. The AC SSL unit comprises at least two SSL devices which are arranged in an anti-parallel manner with respect to one another. Furthermore, the SSL assembly comprises a driver circuit which comprises a resonant circuit that is configured to adapt an input AC drive voltage at an input of the resonant circuit into an output AC drive voltage; wherein the output AC drive voltage is applied to the AC SSL unit.

22 Claims, 6 Drawing Sheets

RESONANCE CONVERTER FOR DRIVING MULTIPLE AC LED STRINGS

TECHNICAL FIELD

The present document relates to cost efficient and power efficient driver circuits for solid state lighting (SSL) devices.

BACKGROUND

Solid State Lighting (SSL) light bulb assemblies, e.g. Light Emitting Diode (LED) based light bulb assemblies, are currently replacing GLS (General Lighting Service) or incandescent lamps. SSL devices typically comprise a driver circuit and/or power converter in order to convert electric power from a mains supply to DC (direct current) electric power suitable for an SSL light source comprised within the SSL device (e.g. an array of LEDs).

An SSL assembly may comprise a plurality of SSL devices, e.g. for generating differently colored light or for generating white light from SSL devices which emit differently colored light. A driver circuit for such an SSL assembly typically comprises a plurality of power converters for driving the plurality of SSL devices, respectively. Alternatively, the electrical power produced by a power converter may be directed sequentially to the different SSL devices of the plurality of SSL devices using a switch.

Hence, SSL assemblies typically comprise driver circuits which exhibit a relatively high number of electronic components and which therefore exhibit relatively high costs. Furthermore, the use of components such as power converters and rectifiers leads to reduced power efficiency.

SUMMARY

The present document addresses the technical problem of providing a cost efficient and a power efficient SSL assembly, notably an SSL assembly which comprises a plurality of SSL devices that are operated in parallel. According to an aspect, an SSL assembly is described. The SSL assembly comprises an alternating current (AC) solid state lighting (SSL) unit, wherein the AC SSL unit comprises at least two SSL devices which are arranged in an anti-parallel manner with respect to one another. Furthermore, the SSL assembly comprises a resonant circuit that is configured to adapt an input AC drive voltage at an input of the resonant circuit into an output AC drive voltage, wherein the output AC drive voltage is applied to the AC SSL unit. The combined use of an AC SSL unit and a resonant circuit for driving the AC SSL unit provides for a cost and power efficient SSL assembly.

According to another aspect, a method for operating a controller and/or a driver circuit and/or an SSL assembly as outlined in the present document is described. The method may comprise steps which correspond to the features of the controller and/or driver circuit and/or the SSL assembly described in the present document. In particular, the method may be for providing an AC drive current and/or an AC drive voltage to an alternating current (AC) solid state lighting (SSL) unit, wherein the AC SSL unit comprises at least two SSL devices which are arranged in an anti-parallel manner with respect to one another. The method comprises adapting an input AC drive voltage at an input of a resonant circuit into an output AC drive voltage using the resonant circuit. Furthermore, the method comprises applying the output AC drive voltage to the AC SSL unit.

The method may be implemented as hardware using logic components as described in the present document. Alternatively, the method may be implemented as software on a processor.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

In the present document, a light bulb "assembly" includes all of the components required to replace a traditional incandescent filament-based light bulb, notably light bulbs for connection to the standard electricity supply. In British English (and in the present document), this electricity supply is referred to as "mains" electricity, whilst in US English, this supply is typically referred to as power line. Other terms include AC power, line power, domestic power and grid power. It is to be understood that these terms are readily interchangeable, and carry the same meaning.

Typically, in Europe electricity is supplied at 230-240 VAC or 230 VAC+10%/-6%, at 50 Hz and in North America at 110-120 VAC or 114V-126V at 60 Hz. The principles set out in the present document apply to any suitable electricity supply, including the mains/power line mentioned, and a rectified AC power supply.

Figure 1:
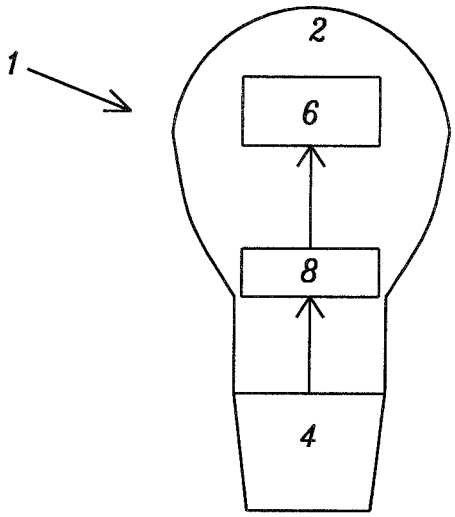
FIG. 1 illustrates a block diagram of an example light bulb assembly.

FIG. 1 is a schematic view of a light bulb assembly as an example for an SSL assembly. The assembly 1 comprises a bulb housing 2 and an electrical connection module 4. The electrical connection module 4 can be of a screw type or of a bayonet type, or of any other suitable connection to a light bulb socket. Typical examples for an electrical connection module 4 are the E11, E14 and E27 screw types of Europe and the E12, E17 and E26 screw types of North America. Furthermore, a light source 6 (also referred to as a SSL device) is provided within the housing 2. Examples for such light sources 6 are a solid state light source or SSL device 6, such as a light emitting diode (LED) or an organic light emitting diode (OLED). The light source 6 may be provided by a single light emitting device, or by a plurality of LEDs. Typical SSL devices 6 comprise a plurality of LEDs arranged in series, such that the on-voltage $V_{on}$ of the SSL device results from the sum of on-voltages of the individual LEDs. Typical values for on-voltages of SSL devices are in the range of 10V-100V.

Usually, the voltage drop across an SSL device 6 remains substantially constant (at the on-voltage $V_{on}$ of the SSL device 6), regardless the intensity of the light emitted by the SSL device 6. The intensity of the light emitted by the SSL device 6 is typically controlled by the drive current through the SSL device 6.

Driver circuit 8 is located within the bulb housing 2, and serves to convert supply electricity (i.e. the mains supply) received through the electrical connection module 4 into a controlled drive voltage and drive current for the light source 6. In the case of a solid state light source 6, the driver circuit 8 is configured to provide a controlled direct drive current to the light source 6.

The housing 2 provides a suitably robust enclosure for the light source and drive components, and includes optical elements that may be required for providing the desired output light from the assembly. The housing 2 may also provide a heat-sink capability, since management of the temperature of the light source may be important in maximising light output and light source life. Accordingly, the housing is typically designed to enable heat generated by the light source to be conducted away from the light source, and out of the assembly as a whole.

Figure 2:
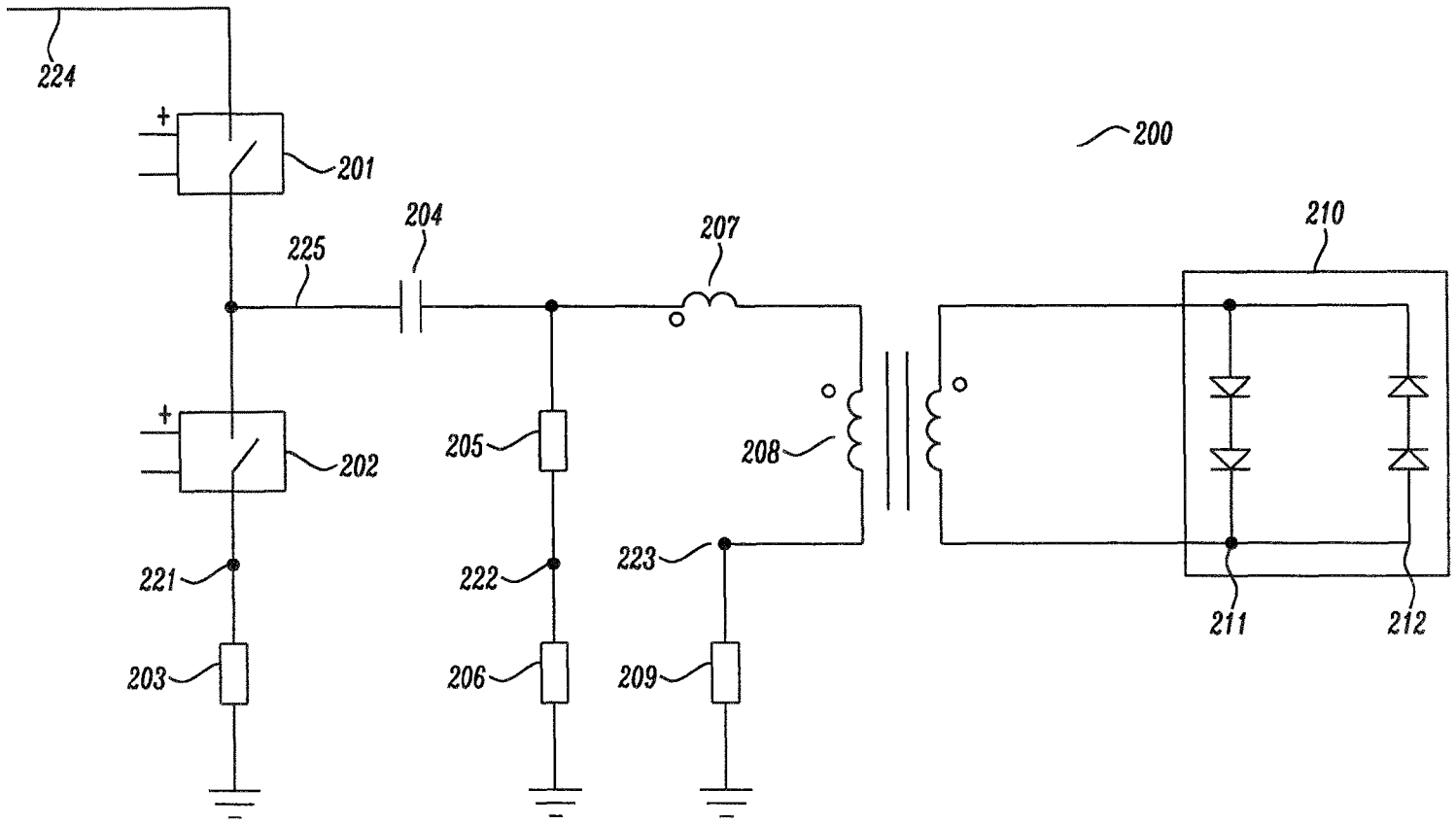
FIG. 2 shows a circuit diagram of an example driver circuit for an AC SSL unit.

As outlined above, the present document is directed at providing a cost and energy efficient driver circuit 8 for SSL devices 6. Typically a driver circuit 8 for an SSL device 6 comprises a power converter for providing a DC drive voltage and a DC drive current for the SSL device 6. FIG. 2 illustrates a driver circuit 200 for an AC (Alternating Current) SSL unit 210 which may be operated using an AC drive voltage and an AC drive current. The AC SSL unit 210 comprises a first SSL device 211 (or a first string of SSL devices) which is configured or arranged to emit light in case of a positive drive voltage and a positive drive current. On the other hand, the first SSL device 211 does not emit any light in case of a negative drive voltage. Furthermore, the AC SSL unit 210 comprises a second SSL device 212 (or a second string of SSL devices) which is configured or arranged to emit light in case of a negative drive voltage and a negative drive current. On the other hand, the second SSL device 212 does not emit any light in case of a positive drive voltage. As such, the AC SSL unit 210 may comprise at least two strings 211, 212 of SSL devices which are arranged in an anti-parallel manner with respect to one another.

The driver circuit 200 for driving such an AC SSL unit 210 may comprise a half bridge 201, 202 for generating an AC drive voltage 225 from a DC input voltage 224. The half bridge 201, 202 may be part of an AC generation unit or AC provisioning unit. The half bridge 201, 202 comprises a high side switch 201 and a low side switch 202 and an AC drive voltage 225 is provided at a midpoint of the half bridge 201, 202 between the high side switch 201 and the low side switch 202. For this purpose, the switches 201, 202 are opened and closed in an alternating manner at a pre-determined frequency. The pre-determined frequency corresponds to the AC frequency of the AC drive voltage 225. The switches 201, 202 may comprise or may be transistors, such as MOS (metal oxide semiconductor) transistors or bipolar transistors. In the illustrated example, the half bridge 201, 202 comprises a shunt resistor 203 for measuring the current through the low side switch 202 (at time instants when the low side switch 202 is closed).

The driver circuit 200 may further comprise a decoupling capacitor 204 which is configured to remove a DC component from the AC voltage 225. Furthermore, the driver circuit 200 may comprise a voltage divider 205, 206 which is configured to provide an indication 222 of the AC drive voltage 225. In addition, the driver circuit 200 may comprise a transformer 208 which is configured to provide a galvanic isolation of the AC SSL unit 210 from the input of the driver circuit 200. FIG. 2 shows the parasitic inductance 207 of the transformer 208. Furthermore, FIG. 2 shows a shunt resistor 209 which is arranged in series with the primary winding of the transformer 208 and which is configured to provide an indication 223 of the AC drive current that is provided to the SSL unit 210.

Using the AC drive voltage 225 and the AC drive current which are provided by the driver circuit 200, the AC SSL unit 210 may be driven to emit light. In particular, the first SLL device 211 of the AC SSL unit 210 may (only) emit light within the positive half cycles of the AC drive voltage 225 and the second SSL device 212 of the AC SSL unit 210 may (only) emit light within the negative half cycles of the AC drive voltage 225. Hence, the AC SSL unit 210 emits light during the positive and negative half cycles of the AC drive voltage 225, i.e. the AC SSL unit 210 emits light at substantially all times.

Notably due to the parasitic inductance 207 of the transformer 208, the AC drive current may exhibit a ramp with a gradient which is smaller than infinity at the transition between the positive and the negative half cycles and/or between the negative and the positive half cycles. As a result of this, there may be time instants at these transitions where neither the first SSL device 211 nor the second SSL device 212 emits light. In order to ensure that the light which is emitted by the AC SSL unit 210 is flicker-free, the AC frequency of the AC drive voltage 225 may be higher than a frequency of light variations which is visible by the human eye. By way of example, the AC frequency may be 400 Hz or higher. Typical frequencies may be in the range of several kHz or several 10 kHz. As such, the resonant converter (formed e.g. by the capacitor 204 and the inductance 207) may be operated at relatively high frequencies.

It may be desirable to drive a plurality of AC SSL units 210 at the same time. By way of example, an SSL assembly 1 may comprise a plurality of AC SSL units 210 which emit differently colored light, in order to provide an SSL assembly 1 that emits colored light (at a particular color temperature) which is composed of the plurality of colors emitted by the corresponding plurality of AC SSL units 210. By way of example, an SSL assembly which emits white light at a particular color temperature may comprise an AC SSL unit which emits blue light, an AC SSL unit which emits green light and an AC SSL unit which emits red light. The plurality of AC SSL units 210 may have different requirements regarding the drive voltage. In particular, the on-voltages of the plurality of AC SSL units 210 may differ. Alternatively or in addition, different levels of AC drive currents may need to be provided to the plurality of AC SSL units 210.

Figure 3:
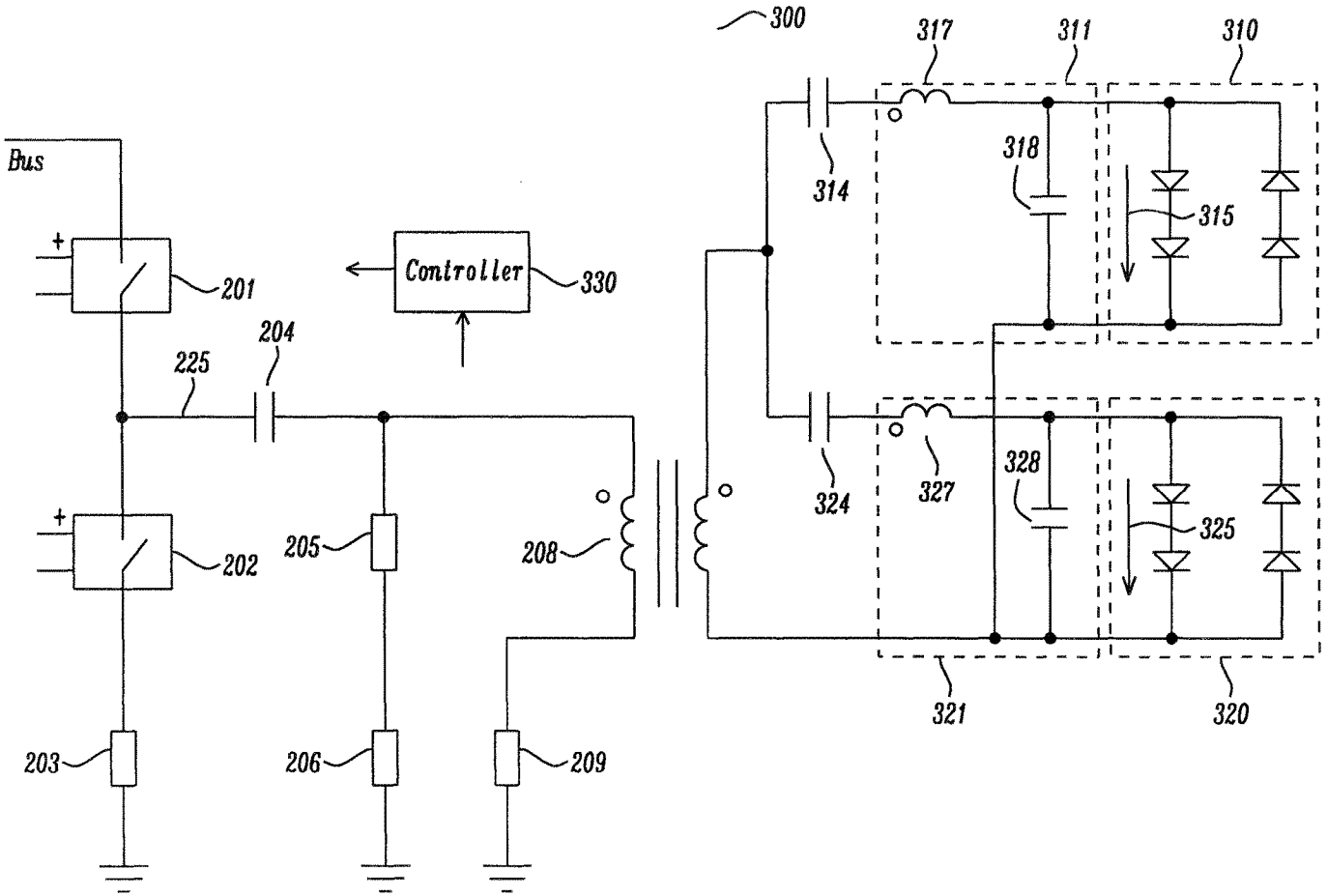
FIG. 3 shows a circuit diagram of an example driver circuit for a plurality of AC SSL units.

FIG. 3 shows a circuit diagram of an example driver circuit 300 for driving a plurality of AC SSL units 310, 320. The driver circuit 300 comprises a half bridge 201, 202 for generating an AC drive voltage 225. The AC SSL units 310, 320 are arranged in parallel with respect to one another. Furthermore, each AC SSL unit 310, 320 is arranged in parallel to the AC drive voltage 225, notably to the secondary winding of the transformer 208. Resonant circuits 311, 321 are used to transform the joint AC drive voltage 225 (i.e. the joint voltage at the secondary winding of the transformer 208 which is derived from the AC drive voltage 225) into individual AC drive voltages 315, 325 for the AC SSL unit 310, 320, respectively. The resonant circuits 311, 321 are arranged between the secondary winding of the transformer 208 and the respective AC SSL units 310, 320. The resonant circuit 311 for an AC SSL unit 310 exhibits a resonance frequency, wherein the resonance frequency may be such that the amplitude of the AC drive voltage 315 at the output of the resonance circuit 311 corresponds to the on-voltage of the AC SSL unit 310 (in case of a joint AC voltage 225 having a pre-determined amplitude).

In the illustrated example, the branch of each AC SSL unit 310, 320 further comprises optional respective decoupling capacitors 314, 324 for removing a possible DC component from the joint AC drive voltage 225.

Furthermore, in the illustrated example, the resonant circuits 311, 321 comprise an LC circuit with an inductor 317, 327 and a capacitor 318, 328. The inductor 317, 327 may correspond to the parasitic inductor 207 of the transformer 208 in FIG. 2.

The use of resonant circuits 311, 321 for adjusting a joint AC drive voltage 225 to the different on-voltages of a plurality of AC SSL units 310, 320 provides a cost- and power-efficient means for driving a plurality of AC SSL units 310, 320.

Overall, the arrangement shown in FIG. 3 enables the provision of cost- and power-efficient SSL assemblies 1 in FIG. 1. The use of AC SSL units 310, 320 enables the provision of driver circuits which do not comprise rectifiers and/or power converters. As a matter of fact, the SSL devices 211, 212 in FIG. 2 within an AC SSL unit 310, 320 act as rectifiers. Furthermore, using resonant converters or resonant circuits 311, 321 (e.g. LLC circuits, LRC circuits, transformers with additional resonance elements, etc.) with different resonance frequencies for each AC SSL unit 310, 320 allows each AC SSL unit 310, 320 to be controlled individually. This may also be done via a galvanic isolation (e.g. the transformer 208). The power losses of such driver circuits 300 are low and do not exhibit rectifier losses.

As illustrated in FIG. 2, the transformer 208 with the leakage inductor 207 may act together with the decoupling capacitor 204 as an LC resonance circuit. The energy is transferred via the transformer 208 over the galvanic isolation towards the AC SSL unit 210 which comprises anti-parallel SSL strings 211, 212. The current through the AC SSL unit 210 may be controlled using the shunt resistor 209 and the voltage (V/I control using also the phase). In view of the fact that the current through the AC SSL unit 210 is an AC current, a real and an imaginary part of the AC current may be determined at the shunt resistor 209. Furthermore, a magnitude of the AC current may be extracted. The current through the AC SSL unit 210 may be controlled based on the real part of the measured current. In this context a cosine-phi correction may be applied to the current which is measured using the shunt resistor 209.

It should be noted that, if no galvanic isolation is required, the current through the AC SSL unit 210 may also be measured directly at the AC SSL unit 210. By way of example, a shunt resistor may be placed (ground related) in series within the string of SSL devices 211, 212. Alternatively or in addition, other sensors (e.g. Hall sensors) may be used for determining the current through the AC SSL unit 210.

The driver circuit 300 of FIG. 3 comprises two different resonant circuits 311, 321 subsequent to the transformer 208. These resonant circuits 311, 321 may be used as frequency splitters. Subject to a change of the frequency of the joint AC voltage 225 on the primary side of the transformer 208, the different resonant circuits 311, 321 react in a different way, and by doing this, the current through the different AC SSL units 310, 320 may be controlled. The behavior of the different resonant circuits 311, 321 may be adjusted by adjusting the resonance frequencies and/or the transfer functions of the different AC SSL units 310, 320. The current control may be performed by measuring the voltage (using the voltage divider 205, 206) and the current (using the shunt resistor 209) at the primary side of the transformer. In this context, cosine-phi correction may be performed.

The driver circuit 300 of FIG. 3 further comprises a controller 330 (e.g. a processor) which is configured to control the AC drive current and/or the AC drive voltage which are provided to the AC SSL units 310, 320. In particular, the controller 330 may be configured to adapt the AC frequency of the AC voltage 225 which is provided by the half bridge 201, 202. By way of example, the controller 330 may be configured to determine the current which is provided to the AC SSL units 310, 320 (e.g. using the shunt resistor 209). Furthermore, the controller 330 may be configured to adapt the AC frequency of the AC voltage 225 in dependence of the determined current, thereby adjusting the AC drive voltages 315, 325 and/or the individual AC drive currents which are applied to the different AC SSL units 310, 320.

Figure 4:
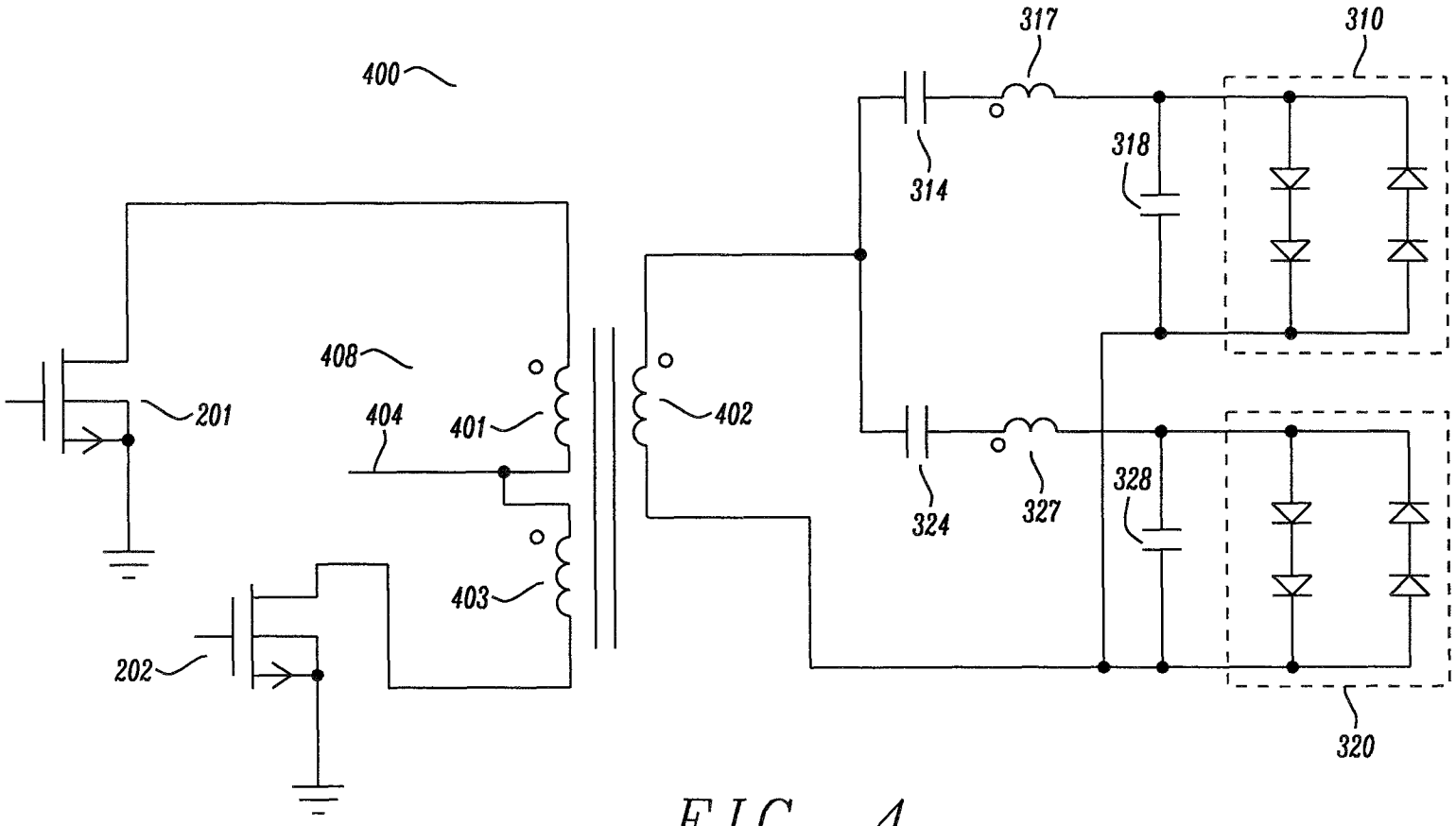
FIG. 4 shows another circuit diagram of an example driver circuit for a plurality of AC SSL units.

FIG. 4 shows a driver circuit 400 which makes use of a push-pull transformer 408 for generating the joint AC drive voltage. In the illustrated example, the primary winding 401, 403 of the transformer 408 is split in an upper winding 401 and in a lower winding 403. The high side switch 201 is arranged at a high side of the upper winding 401 and the low side switch 202 is arranged at a low side of the lower winding 403. The midpoint 404 of the half bridge (at which the joint AC drive voltage 225 is provided) is situated at the coupling point between the lower side of the upper winding 401 and the upper side of the lower winding 403. Furthermore, the transformer 408 comprises a secondary winding 402 for providing the AC drive voltage and the drive current to the plurality of AC SSL units 310, 320 (via the different resonant circuits 311, 321 in FIG. 3).

Figure 5:
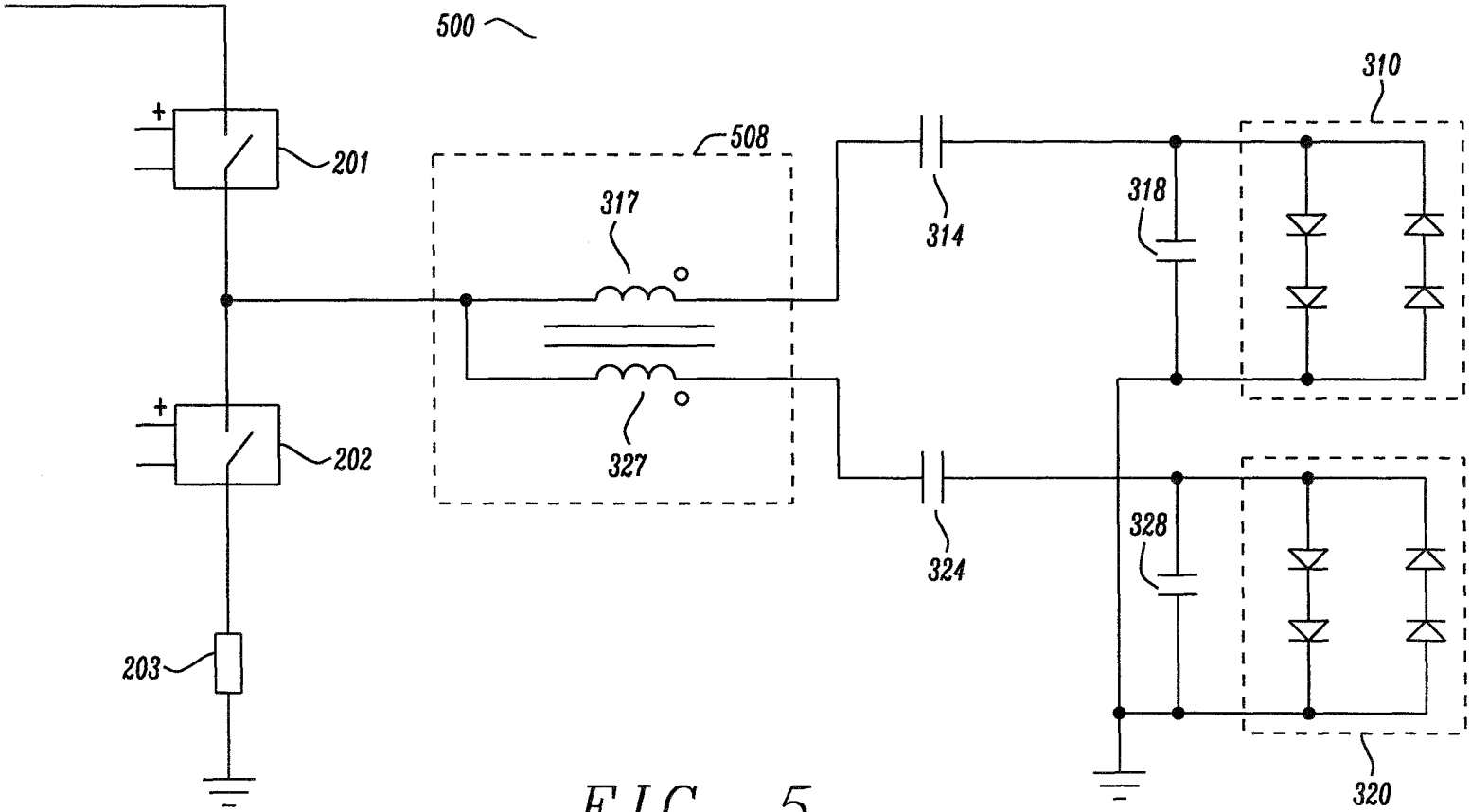
FIG. 5 shows another circuit diagram of an example driver circuit for a plurality of AC SSL units.

FIG. 5 shows an example driver circuit 500, wherein a common inductor coil 508 is used to form the resonant circuits 311,321 for the AC SSL units 310, 320. The common inductor coil 508 comprises two inductors 317, 327 on one core, with a relatively weak coupling between the two inductors 317, 327.

Hence, according to a broad aspect, the present document describes an SSL assembly (e.g. an SSL light bulb assembly). The SSL assembly comprises at least one AC (alternating current) SSL (solid state lighting) unit 210, 310, 320. The AC SSL unit 210, 310, 320 comprises at least two SSL devices 211, 212 which are arranged in an anti-parallel manner with respect to one another. The at least two SSL devices 211, 212 may each comprise one or more light emitting diodes.

Furthermore, the SSL assembly comprises a driver circuit 200, 300, 400, 500 which comprises a resonant circuit 311, 321 that is configured to adapt an input AC drive voltage 225 at an input of the resonant circuit 311, 321 into an output AC drive voltage 315, 325. In particular, the resonant circuit 311, 321 may be configured to provide an output AC drive voltage 315, 325 having an amplitude which differs from an amplitude of the input AC drive voltage 225. In particular, the amplitude of the output AC drive voltage 315, 325 may be such that it is equal to or exceeds an on-voltage of the AC SSL unit 210, 310, 320, at which the SSL devices 211, 212 of the AC SSL unit 210, 310, 320 emit light.

The input AC drive voltage 225 may be generated by the driver circuit 200, 300, 400, 500 (e.g. from a DC voltage) or may be provided at an input of the driver circuit 200, 300, 400, 500. The output AC drive voltage 315, 325 is applied to the AC SSL unit 210, 310, 320, thereby triggering the AC SSL unit 210, 310, 320 to emit light.

The use of an AC SSL unit 210, 310, 320 in combination with a resonant circuit 311, 321 for adjusting an AC drive voltage for the AC SSL unit provides a cost efficient and a power efficient implementation for an SSL assembly.

The driver circuit 200, 300, 400, 500 may comprise AC generation circuitry 201, 202 which is configured to generate the input AC drive voltage 225 at an AC frequency. The AC generation circuitry 201, 202 may comprise a high side switch 201 and a low side switch 202 which are arranged in series between a high potential (e.g. a DC input voltage) and a low potential (e.g. ground). The high side switch 201 and the low side switch 202 may be closed and opened in an alternating manner at the AC frequency.

The input AC drive voltage 225 may be derived from a voltage at a midpoint between the high side switch 210 and the low side switch 202.

Furthermore, the driver circuit 200, 300, 400, 500 may comprise a controller 330 (e.g. a processor) which is configured to control the AC generation circuitry 201, 202 to change the AC frequency of the input AC drive voltage 225. In particular, the controller 330 may be configured to determine an indication 223 for an AC drive current through the AC SSL unit 210, 310, 320. The indication 223 may be determined using current measurement means (such as a shunt resistor 209). The controller 330 may be configured to adapt an AC frequency of the input AC drive voltage 225 in dependence of the indication 209 for the AC drive current. By doing this, the AC drive current through the AC SSL unit 210, 310, 320 may be modified in an efficient manner. In particular, the amplitude of the AC output voltage 315, 325 may be modified by modifying the AC frequency of the input AC drive voltage 225. This is due to the varying amplification or attenuation of the resonant circuit 311, 321, which depends on the AC frequency. The varying amplification or attenuation of the resonant circuit 311, 321 may be described by a transfer function of the resonant circuit 311, 321.

The driver circuit 200, 300, 400, 500 may comprise a transformer 208 which is arranged between the AC generation circuitry 201, 202 and the AC SSL unit 210, 310, 320. The transformer 208 may provide for a galvanic isolation of the AC SSL unit 210, 310, 320. Furthermore, the driver circuit 200, 300, 400, 500 may comprise a shunt resistor 209 which is arranged in series with a primary winding of the transformer 208. The indication 223 for the AC drive current may be dependent on or may correspond to a voltage drop at the shunt resistor 209.

The SSL assembly may comprise a plurality of AC SSL units 310, 320 which are arranged in parallel with respect to one another. The on-voltages of the different AC SSL units 310, 320 may differ from one another. The driver circuit 300, 400, 500 may comprise a corresponding plurality of resonant circuits 311, 321 for the plurality of AC SSL units 310, 320, respectively. The resonant circuit 311, 321 of an AC SSL unit 310, 320 may be arranged between the AC generation unit 201, 202 and the respective AC SSL unit 310, 320. Each of the plurality of resonant circuits 311, 321 may be configured to adapt the (joint) input AC drive voltage 225 at the input of the respective resonant circuit 311, 321 into an output AC drive voltage 315, 325 which is applied to the respective AC SSL unit 310, 320. In other words, the same input AC drive voltage 225 may be applied to the input of each of the plurality of resonant circuits 311, 321. On the other hand, the output AC drive voltages at the output of the resonant circuits 311, 321 may differ and may be adapted to the requirements of the respective AC SSL units 310, 320 and/or to the desired drive currents for the respective AC SSL units 310, 320.

Hence, a cost and power efficient SSL assembly which comprises a plurality of AC SSL units may be provided.

A first resonant circuit 311, 321 for a corresponding first AC SSL unit 310, 320 may exhibit a resonance frequency which is dependent on an on-voltage of the first AC SSL unit 310, 320. As such, the plurality of resonant circuits 311, 321 may be used to generate different output AC drive voltages 315, 325 in accordance to the different requirements (e.g. on-voltages) of the different AC SSL units 310, 320, from a single input AC drive voltage 225.

The plurality of resonant circuits 311, 321 may comprise a joint inductor (e.g. the parasitic inductor 207 of a transformer 208 of the driver circuit). On the other hand, the plurality of resonant circuits 311, 321 may comprise different capacitors 318, 328. The different capacitors 318, 328 may exhibit different capacitance values, thereby providing different resonance frequencies for the plurality of resonant circuits 311, 321. By way of example, the one or more resonant circuits 311, 321 may comprise an LC circuit, an LLC circuit; and/or an LRC circuit.

The driver circuit 200, 300, 400, 500 may comprise a push-pull transformer 408 which is configured to provide the input AC drive voltage 225. The push-pull transformer 408 provides an efficient means for combining an AC generation unit or AC generation circuitry 201, 202 with a transformer 208.

It should be noted that the number of AC SSL units 310 per resonant circuit 311 may vary. Furthermore, it should be noted that a capacitance of an SSL device 211, 212 comprised within an AC SSL unit 310 may contribute to the resonance frequency of a resonant circuit 311.

Figure 6:
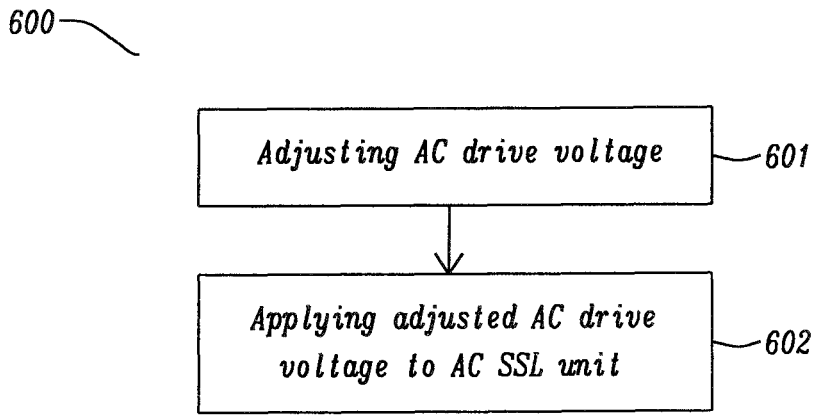
FIG. 6 shows a flow chart of an example method for operating an AC SSL unit.

FIG. 6 shows a flow chart of an example method 600 for providing an AC drive current to an AC SSL unit 210, 310, 320. As indicated above, the AC SSL unit 210, 310, 320 typically comprises at least two SSL devices 211, 212 which are arranged in an anti-parallel manner with respect to one another. The method 600 comprises adapting 601 an input AC drive voltage 225 at an input of a resonant circuit 311, 321 into an output AC drive voltage 315, 325 using the resonant circuit 311, 321. Furthermore, the method 600 comprises applying 602 the output AC drive voltage 315, 325 to the AC SSL unit 210, 310, 320.

The methods and circuits described in the present document allow controlling SSL devices 211, 212 with a reduced number of electronic components. In particular, no rectifiers and/or resistive elements are required. As such, cost and power efficient SSL assemblies may be provided. As illustrated, transformers with leakage inductors may be used for providing resonant circuits. It should be noted, however, that other resonance concepts may be used (e.g. LRC/Class E circuits). Such resonance circuits typically have a high efficiency.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. An SSL assembly comprising an alternating current, referred to as AC, solid state lighting, referred to as SSL, unit; wherein the AC SSL unit comprises at least two SSL devices which are arranged in an anti-parallel manner with respect to one another; and a driver circuit which comprises a resonant circuit that is configured to adapt an input AC drive voltage at an input of the resonant circuit into an output AC drive voltage; wherein the output AC drive voltage is applied to the AC SSL unit; wherein the SSL assembly comprises a plurality of AC SSL units which are arranged in parallel with respect to one another;

the driver circuit comprises a corresponding plurality of resonant circuits; wherein each resonant circuit of the plurality of resonant circuits for a corresponding AC SSL unit of the plurality of AC SSL units exhibits a resonance frequency which is dependent on an on-voltage of the corresponding AC SSL unit; and each of the plurality of resonant circuits is configured to adapt the input AC drive voltage at the input of the respective resonant circuit into an output AC drive voltage which is applied to the respective AC SSL unit.

2. The SSL assembly of claim 1, wherein the resonant circuit is configured to provide an output AC drive voltage having an amplitude which differs from an amplitude of the input AC drive voltage.

3. The SSL assembly of claim 1, wherein the driver circuit further comprises AC generation circuitry which is configured to generate the input AC drive voltage at an AC frequency.

4. The SSL assembly of claim 3, wherein the driver circuit further comprises a controller which is configured to control the AC generation circuitry to change the AC frequency of the input AC drive voltage.

5. The SSL assembly of claim 4, wherein the controller is configured to determine an indication for an AC drive current through the AC SSL unit; and adapt an AC frequency of the input AC drive voltage in dependence of the indication for the AC drive current.

6. The SSL assembly of claim 5, wherein the driver circuit comprises a transformer which is arranged between the AC generation circuitry and the AC SSL unit; and a shunt resistor which is arranged in series with a primary winding of the transformer; wherein the indication for the AC drive current is dependent on a voltage drop at the shunt resistor.

7. The SSL assembly of claim 3, wherein the AC generation circuitry comprises a high side switch and a low side switch which are arranged between a high potential and a low potential;

the high side switch and the low side switch are closed and opened in an alternating manner at the AC frequency; and the input AC drive voltage is derived from a voltage at a midpoint between the high side switch and the low side switch.

8. The SSL assembly of claim 1, wherein the plurality of resonant circuits comprise a joint inductor; and the plurality of resonant circuits comprise different capacitors.

9. The SSL assembly of claim 1, wherein the resonant circuit comprises one or more of:

an LC circuit;

an LLC circuit; and/or an LRC circuit.

10. The SSL assembly of claim 1, wherein the driver circuit comprises a push-pull transformer configured to provide the input AC drive voltage.

11. The SSL assembly of claim 1, wherein the at least two SSL devices comprise one or more light emitting diodes.

12. A method for providing AC drive currents to a plurality of alternating current, referred to as AC, solid state lighting, referred to as SSL, units; wherein the plurality of AC SSL units are arranged in parallel with respect to one another; wherein the AC SSL units each comprises at least two SSL devices which are arranged in an anti-parallel manner with respect to one another; wherein the method comprises the steps of:

adapting an input AC drive voltage at inputs of a plurality of resonant circuits into a plurality of output AC drive voltages for the plurality of AC SSL units using the plurality of resonant circuits; wherein each resonant circuit of the plurality of resonant circuits for a corresponding AC SSL unit of the plurality of AC SSL units exhibits a resonance frequency which is dependent on an on-voltage of the corresponding AC SSL unit; and applying the output AC drive voltages to the respective AC SSL units.

13. The method for providing an AC drive current to an alternating current of claim 12, further comprising the step of:

providing an output AC drive voltage having an amplitude which differs from an amplitude of the input AC drive voltage by a resonant circuit.

14. The method for providing an AC drive current to an alternating current of claim 12, further comprising the step of:

generating the input AC drive voltage at an AC frequency by AC generation circuitry of the driver circuit.

15. The method for providing an AC drive current to an alternating current of claim 14, further comprising the step of:

controlling the AC generation circuitry to change the AC frequency of the input AC drive voltage by a controller of the driver circuit.

16. The method for providing an AC drive current to an alternating current of claim 15, further comprising the steps of:

determining an indication for an AC drive current through the AC SSL unit; and adapting an AC frequency of the input AC drive voltage in dependence of the indication for the AC drive current.

17. The method for providing an AC drive current to an alternating current of claim 16, wherein the driver circuit comprises a transformer which is arranged between the AC generation circuitry and the AC SSL unit; and a shunt resistor which is arranged in series with a primary winding of the transformer; wherein the indication for the AC drive current is dependent on a voltage drop at the shunt resistor.

18. The method for providing an AC drive current to an alternating current of claim 14, wherein the AC generation circuitry comprises a high side switch and a low side switch which are arranged between a high potential and a low potential;

the high side switch and the low side switch are closed and opened in an alternating manner at the AC frequency; and the input AC drive voltage is derived from a voltage at a midpoint between the high side switch and the low side switch.

19. The method for providing an AC drive current to an alternating current of claim 12, wherein the plurality of resonant circuits comprise a joint inductor; and the plurality of resonant circuits comprise different capacitors.

20. The method for providing an AC drive current to an alternating current of claim 12, wherein the resonant circuit comprises one or more of:

an LC circuit;

an LLC circuit; and/or an LRC circuit.

21. The method for providing an AC drive current to an alternating current of claim 12, further comprising the step of:

providing the input AC drive voltage by the driver circuit which comprises a push-pull transformer.

22. The method for providing an AC drive current to an alternating current of claim 12, wherein the at least two SSL devices comprise one or more light emitting diodes.

* * * * *